US009863745B2

(12) United States Patent
DeHart

(10) Patent No.: US 9,863,745 B2
(45) Date of Patent: Jan. 9, 2018

(54) ROTATIONAL LOCK MECHANISM FOR ACTUATOR

(75) Inventor: John K. DeHart, Soperton, GA (US)

(73) Assignee: Parker-Hannifin Corporation, Cleveland, OH (US)

( * ) Notice: Subject to any disclaimer, the term of this patent is extended or adjusted under 35 U.S.C. 154(b) by 1812 days.

(21) Appl. No.: 13/289,275

(22) Filed: Nov. 4, 2011

(65) Prior Publication Data

US 2012/0111993 A1 May 10, 2012

Related U.S. Application Data

(60) Provisional application No. 61/410,012, filed on Nov. 4, 2010.

(51) Int. Cl.
*F42B 10/64* (2006.01)

(52) U.S. Cl.
CPC ..... *F42B 10/64* (2013.01)

(58) Field of Classification Search
CPC ..... F16D 2011/006; F16D 2011/008; F16D 2011/14; Y10T 74/19614; Y10T 74/19619; Y10T 4/20636; Y10T 4/2048; Y10T 4/20492; F42B 10/60; F42B 10/62; F42B 10/64; F42B 19/01
USPC ..... 192/69.62, 69.71; 244/3.24, 91, 99.3
See application file for complete search history.

(56) References Cited

U.S. PATENT DOCUMENTS

| | | | | |
|---|---|---|---|---|
| 2,688,526 | A | 9/1954 | Ulrich | |
| 3,029,539 | A | 4/1962 | Glass et al. | |
| 3,743,067 | A * | 7/1973 | Bokovoy | 192/43 |
| 4,795,110 | A | 1/1989 | Lang | |
| 4,848,306 | A | 7/1989 | Treaster | |
| 5,409,185 | A | 4/1995 | Oldakowski | |
| 5,950,963 | A | 9/1999 | Speicher et al. | |
| 6,250,584 | B1 | 6/2001 | Hsu et al. | |
| 6,701,907 | B2 | 3/2004 | Christopher et al. | |
| 7,316,370 | B2 | 1/2008 | Sankovic et al. | |
| 7,445,002 | B2 | 11/2008 | Christopher et al. | |
| 2006/0054151 | A1 | 3/2006 | Christopher et al. | |

FOREIGN PATENT DOCUMENTS

EP 0 601 794 A1 6/1994

* cited by examiner

*Primary Examiner* — Richard W Ridley
*Assistant Examiner* — Brian J McGovern
(74) *Attorney, Agent, or Firm* — Renner, Otto, Boisselle & Sklar, LLP

(57) ABSTRACT

Provided is a rotational lock for a control surface, the rotational lock having an output gear including one or more locking members alignable with corresponding locking members on a lock plate in an unlocked position of the rotational lock, the locking members being engageable upon the axial movement of the lock plate to couple the lock plate and lock gear for common rotation. In this way, a rotational lock can be provided that is lightweight, utilizes minimal components, and utilizes an existing motor that actuates the control surface and unlocks the mechanism.

17 Claims, 9 Drawing Sheets

ROTATIONAL LOCK MECHANISM FOR ACTUATOR

RELATED APPLICATIONS

This application claims the benefit of U.S. Provisional Application No. 61/410,012 filed Nov. 4, 2010, which is hereby incorporated herein by reference.

FIELD OF THE INVENTION

The present invention relates generally to lock mechanisms, and more particularly to a rotational lock mechanism for a control surface.

BACKGROUND

Flight control systems for devices, such as missiles, include control surfaces, such as fins, that are movable and controllable during flight. When the devices are carried on an exterior of an aircraft, for example under a wing, the devices are subjected to high aerodynamic loading. This loading causes the control surfaces to move in the direction of the load. When the control system is turned on, the system usually is unable to recognize that the control surface has been moved, and therefore a flight path of the device will not be accurately controlled. The loading also puts loads on a control mechanism for the control surface that may cause failure or fatigue that would further prevent the device from being accurately controlled.

To avoid high aerodynamic loading, a locking device may be provided to lock the control surface in a selected position. The control surface may be locked in a null position from which it is released only on command from the control system. The locking device may be resettable, for example, to permit the control mechanism to undergo preflight testing.

SUMMARY OF INVENTION

The present invention provides a rotational lock for a control surface, the rotational lock having an output gear including one or more locking members alignable with corresponding locking members on a lock plate in an unlocked position of the rotational lock, the locking members being engageable upon the axial movement of the lock plate to couple the lock plate and lock gear for common rotation. In this way, a rotational lock can be provided that is lightweight, utilizes minimal components, and utilizes an existing motor that actuates the control surface and unlocks the mechanism.

In particular, the rotational lock for the control surface includes an output gear rotatable about an output shaft and a lock plate keyed to the output shaft, the output gear and lock plate being axially movable along the output shaft, and a retention mechanism configured to engage the lock plate in a first position to prevent rotation of the lock plate and configured to disengage from the lock plate during axial movement of the lock plate to allow rotation of the lock plate, wherein the output gear includes one or more locking members alignable with corresponding locking members on the lock plate in a second position, the locking members being engageable upon the axial movement of the lock plate to couple the lock plate and lock gear for common rotation.

In one embodiment, the lock plate locking members include a plurality of tabs on a first face of the lock plate adjacent the output gear and the output gear locking members include a plurality of bores extending at least partially through the output gear for receiving the tabs respectively in the second position.

In another embodiment, the output gear includes a plurality of detents on a face of the output gear adjacent the lock plate, the plurality of detents being engageable with the plurality of tabs in the first position.

In yet another embodiment, the output gear includes a mechanical zero tab projecting outwardly from the face of the output gear toward the lock plate, the mechanical zero tab being configured to interfere with the torque tab during rotation of the output gear to set the control surface in a null position.

According to another aspect of the invention, a rotational lock system for a control surface includes a motor, an output shaft configured to be coupled to a control surface, an output gear coupled to the motor by a gear train, the output gear being rotatable about the output shaft and axially movable along the output shaft, a lock plate keyed to the output shaft and axially movable along the output shaft, and a retention mechanism configured to engage the lock plate in a first position to prevent rotation of the lock plate. In a first movement state of the motor, actuation of the motor causes the output gear to move from a first position to a second position so that one or more locking members on the output gear align with corresponding locking members on the lock plate thereby moving the lock plate axially toward the output gear to a second position to disengage the lock plate from the retention mechanism to couple the lock plate and lock gear for common rotation and in a second movement state of the motor, actuation of the motor causes the output shaft to rotate to move the control surface to a desired position.

In one embodiment, the system includes a controller for controlling the motor.

According to still another aspect of the invention, a method of unlocking a control surface that is locked by a rotational lock, the rotational lock including an output gear and a lock plate, the output gear having a plurality of detents on a face of the output gear that are engageable with a plurality of tabs on a face of the lock plate in a locked position, and a retention mechanism that engages the lock plate in the locked position. The method includes rotating the output gear in a first direction so that a mechanical zero tab on the face of the output gear contacts one of the tabs, rotating the output gear in a second direction to align a plurality of bores extending at least partially through the output gear with the plurality of tabs, and shifting the lock plate axially toward the output gear until the tabs are engaged with the bores, thereby disengaging the lock plate from the retention mechanism and unlocking the control surface.

The foregoing and other features of the invention are hereinafter described in greater detail with reference to the accompanying drawings.

DETAILED DESCRIPTION

The principles of the present invention have particular application to flight control systems for missiles that include control surfaces, such as fins and thus will be described below chiefly in this context. It will of course be appreciated, and also understood, that the principles of the invention may be useful in other applications where external forces act on control surface.

Figure 1:
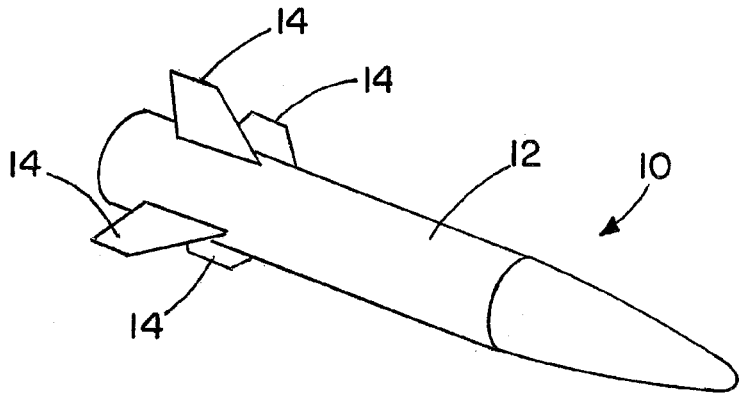
FIG. 1 is a perspective view of a missile with a plurality of rotatable fins.
Figure 15:
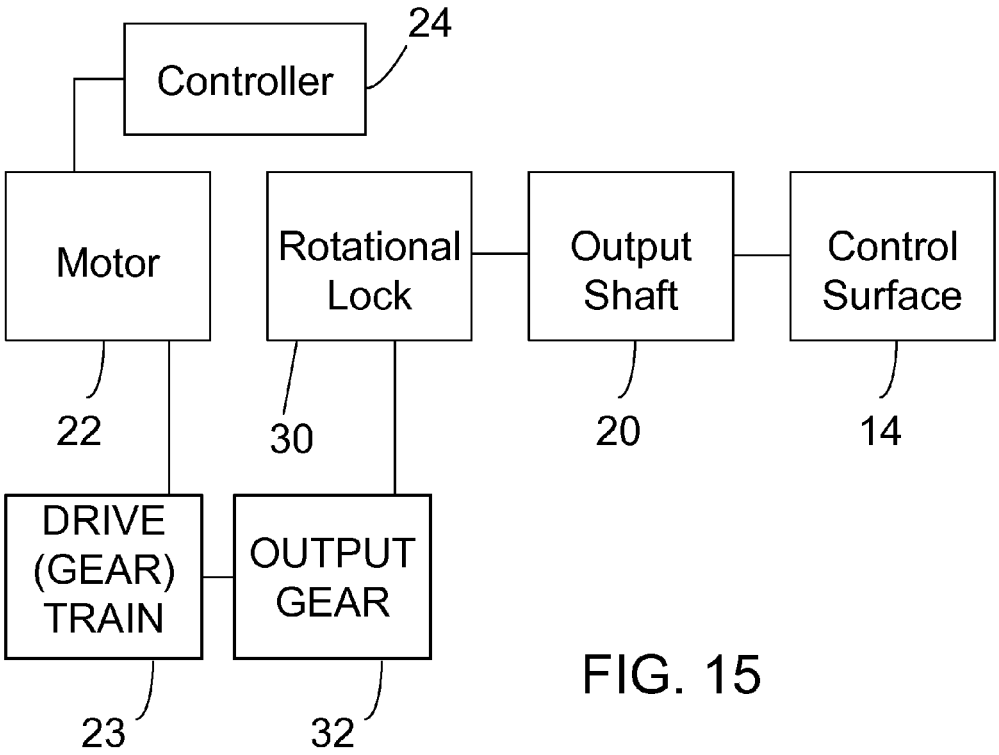
FIG. 15 is a schematic illustration of a rotational lock system.

Referring now in detail to the drawings and initially to FIG. 1, a missile 10 is shown having a body 12 and a plurality of control surfaces, such as fins 14. The fins are coupled to respective output shafts 20, and respective motors 22 (FIG. 15), which may be any suitable motor, are connected through gear trains 23 to each output shaft 20 under certain conditions, such that one or more controllers controller 24 (FIG. 15) can cause the motors 22 to actuate to cause the output shafts 20 to rotate, thereby causing the fins 14 to be moved to a desired position.

Figure 2:
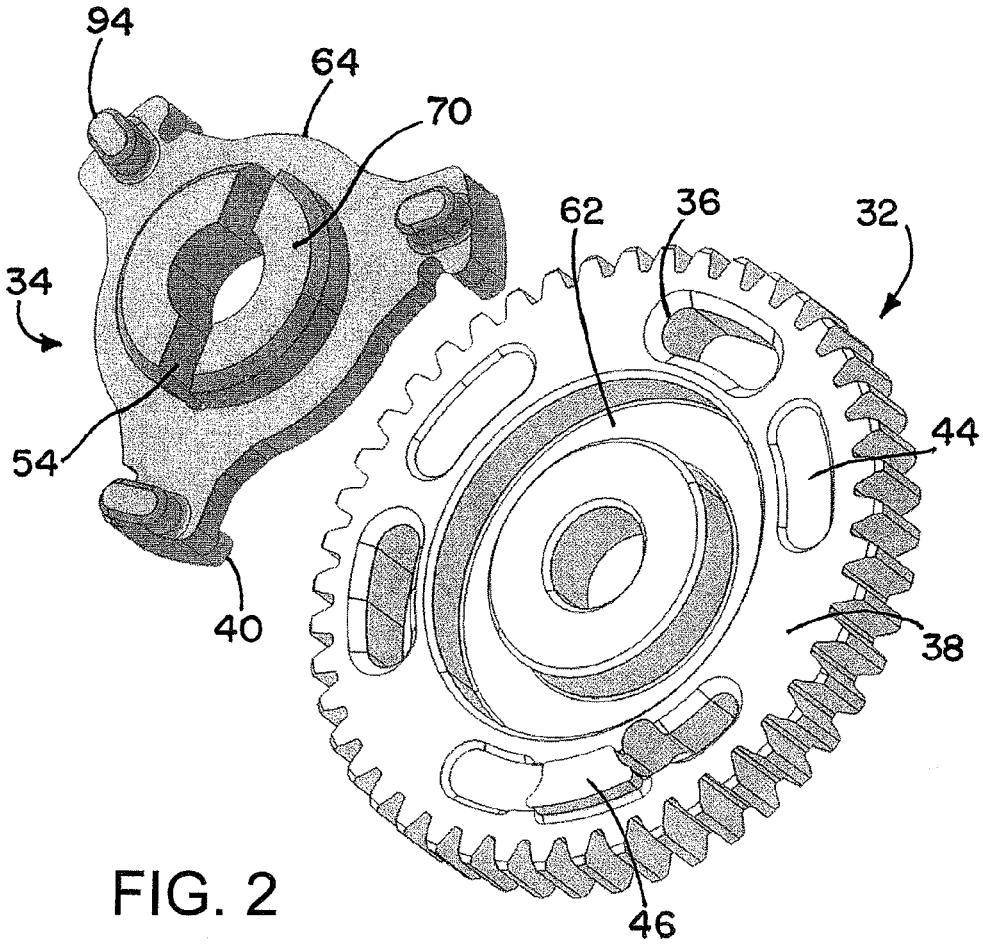
FIG. 2 is a perspective view of an output gear and lock plate according to the invention.
Figure 3:
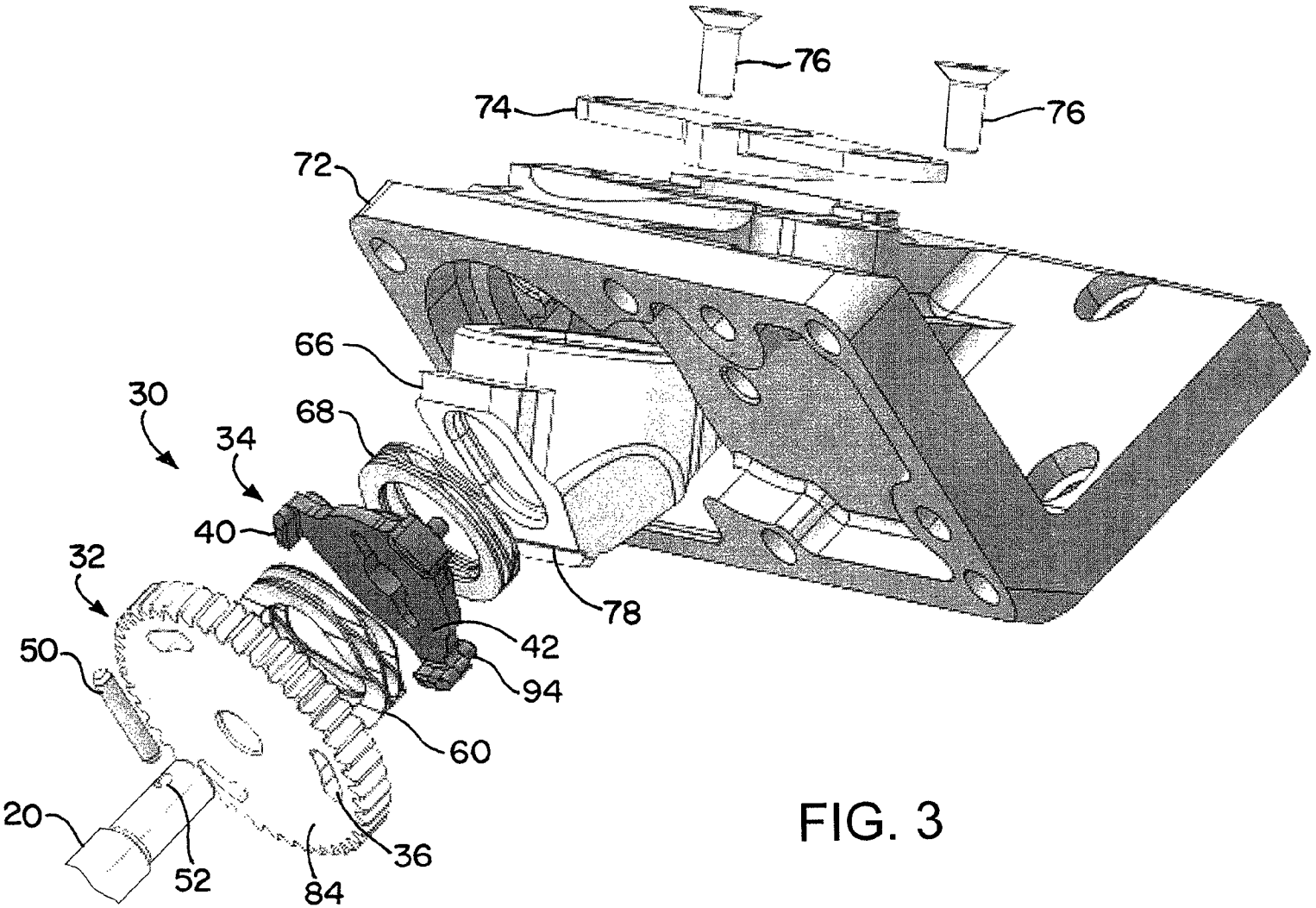
FIG. 3 is an exploded perspective view of an exemplary rotational lock according to the invention.

Turning now to FIGS. 2 and 3, an exemplary rotational lock mechanism 30 for locking the fins in a null position is shown. The rotational lock 30 maintains the fins in the null position during handling, ground transportation and flight. The rotational lock includes an output gear 32 and a lock plate 34 that are mounted on the output shaft 20. The output gear 32 includes a plurality of locking members 36, which may be a plurality of bores and will hereinafter be referred to as such. The bores 36 are spaced about a first face 38 of the gear and extend from the first face 38 at least partially through the output gear 32. As shown, the bores 36 are countersunk and extend completely through the gear 32. The bores 36 are alignable with corresponding locking members 40 on the lock plate 34 in an unlocked position of the rotational lock 30 to couple the lock plate and lock gear for common rotation as will be discussed further below. The locking members 40 on the lock plate 34 may be a plurality of tabs and will hereinafter be referred to as such, which are spaced about and project outwardly from a first face 42 of lock plate 34.

The output gear 32 also includes a plurality of locking members 44, which may be detents adjacent respective bores 36 and will herein be described as such. The detents 44 extend from the first face 38 of the output gear 32 partially through the output gear. The plurality of detents 44 are engageable with the plurality of tabs 40 in a locked position of the rotational lock 30 to prevent movement of the fin from the null position as will be discussed further below.

To set the fin 14 in the null position, the output gear 32 includes a mechanical zero tab 46 in-between one of the bores 36 and one of the detents 44. The mechanical zero tab 46 projects outwardly from the first face 38 of the output gear toward the lock plate 34 to interfere with one of the tabs 40 during rotation of the output gear. When the mechanical zero tab 46 contacts the tab 40 during rotation, the controller 24 knows that the fin 14 is set in the null position.

When assembled, the output gear 32 is coupled through the gear train to the motor and is axially movable along the output shaft 20 and rotatable about the output shaft 20. The lock plate 34 is axially movable along the output shaft 20 and keyed to the shaft such that the motor can rotate the output gear without moving the fin 14 in the locked position. The lock plate 34 is keyed to the shaft 20 in any suitable manner, such as by a lock pin 50 that is received in a through hole 52 in the shaft and received in a capture slot 54 in a central portion of the lock plate. The lock pin 50 allows the lock plate 34 to move axially along the shaft from the locked position to the unlocked position while reacting torque from the fin in either position. Therefore, the rotational lock can be rotationally coupled and decoupled to the motor while maintaining its connection to the fin.

The output gear 32 and the lock plate 34 are mounted on the shaft 20 with the first face 38 adjacent the first face 42. Disposed between the output gear 32 and the lock plate 34 is a spring 60 seated in a recess 62 on the first face 38 of the output gear 32. The spring may be any suitable spring provided to move the lock plate from the locked position to the unlocked position. Disposed between a second face 64 of the lock plate 34 and a spring loader 66 is a spring 68. The spring 68 is seated by a protrusion 70 on the second face 64. The spring 68 may be any suitable spring provided to bias the lock plate 34 in the locked position.

The spring loader 66 is housed in a cover housing 72 having a lock cover 74. The lock cover 74 may be removably secured to the cover housing 72 by any suitable means, such as by fasteners 76. When the lock cover 74 is secured to the cover housing 72, the lock cover 74 applies a preload to the spring loader 66 to load the spring 68. When unloaded, the spring 68 biases the lock plate 34 in the locked position.

In the illustrated embodiment, the missile 10 includes two spring loaders 66 and two cover housings 72 disposed in the body 12. Each spring loader 66 includes first and second faces 78 and 80, the face 78 being adjacent a respective spring 68 for a first rotational lock and the face 80 being adjacent a respective spring 68 for a second rotational lock. Accordingly, a missile having four fins 14 and four rotational locks may include two spring loaders 66 and two cover housings 72 to be set/reset, each spring loader 66 and cover housing 72 being provided for two fins. In the illustrated embodiment the missile also includes four motors, each motor being mechanically coupled to a respective rotational lock. It will be appreciated that although described as having a spring loader 66 and cover housing 72 for two fins, each fin may include its own spring loader 66 and cover housing 72.

Figure 4:
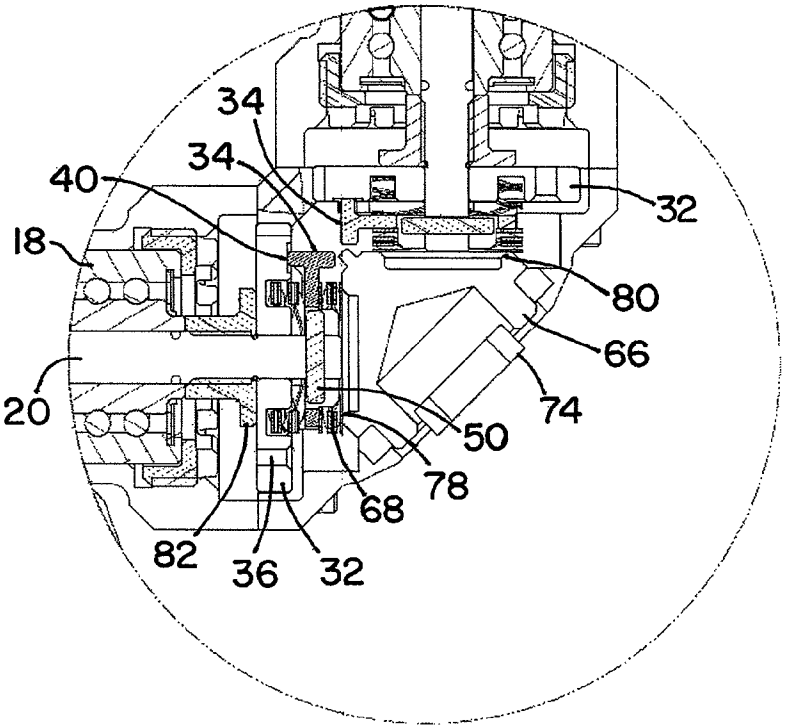
FIG. 4 is a partial cross-sectional view of two exemplary rotational locks according to the invention.

Turning now to FIG. 4, a cross-sectional view is provided illustrating two rotational locks 30 that are loaded by the spring loader 66. Accordingly, each rotational lock 30 is shown in the locked position with each lock plate 34 being biased in the locked position by the springs 68, thereby causing the plurality of tabs 40 to be engaged with the plurality of detents 44. Each output gear 32 is prevented from moving axially away from the respective lock plate 34 by a respective spacer 82 having an end abutting a second face 84 of the output gear 34. The spacer 82 is coupled to the output shaft 20 and also serves to retain a bearing 18 in place.

Figure 5:
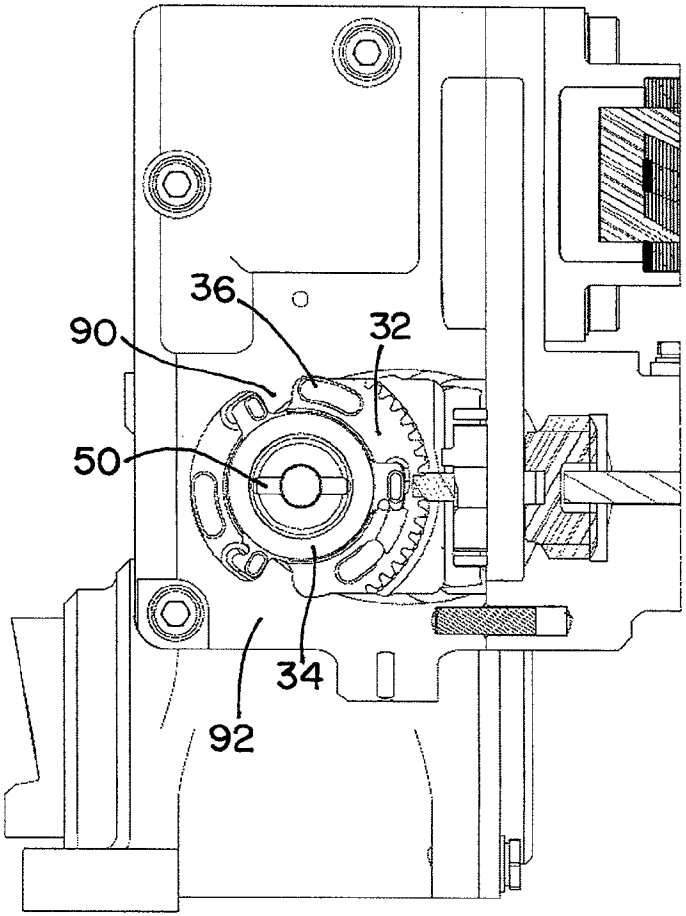
FIG. 5 is a cut away view of a housing of the missile showing details of the rotational lock according to the invention.

Turning now to FIG. 5, a retention mechanism 90 of the rotational lock is shown. When the lock plate 34 is in the locked position, the output gear 32 is free to rotate about the shaft 20 within a prescribed angle controlled by the mechanical zero tab 46. In the illustrated embodiment, the prescribed angle is the distance from one end of the detents 44 to the other end of the detents 44. The rotational freedom of the output gear 32 allows the fin 14 to be decoupled from the motor rotation in the locked position.

To prevent the fin 14 from being moved from the null position when the output gear 32 rotates and/or when the fin is subjected to high aerodynamic loading, the retention mechanism 90 is engageable with the lock plate 34 to prevent the lock plate 34 from rotating. The retention mechanism 90 may be a plurality of protrusions extending inward from a housing 92 surrounding the gear train, and will hereinafter be referred to as such. The lock plate 34 includes a plurality of locking members 94 engageable with the corresponding protrusions 90. The locking members 94 may be a plurality of lock tabs and will hereinafter be referred to as such. The lock tabs 94 are provided on the second face 64 of the lock plate 34 and are engageable by the protrusions 90 in the locked position.

Figure 6:
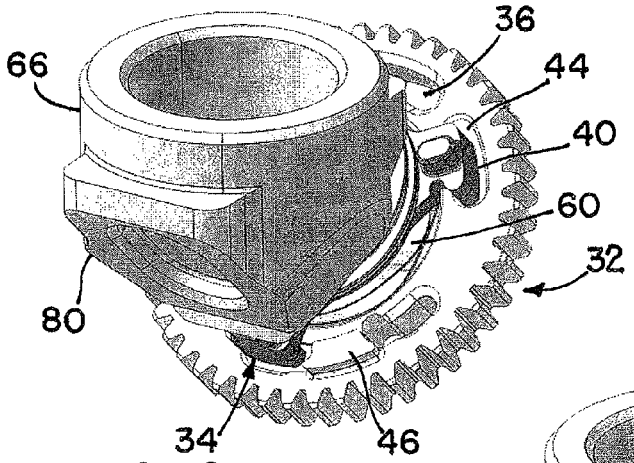
FIG. 6 is a perspective view of the exemplary rotational lock in a locked position.
Figure 7:
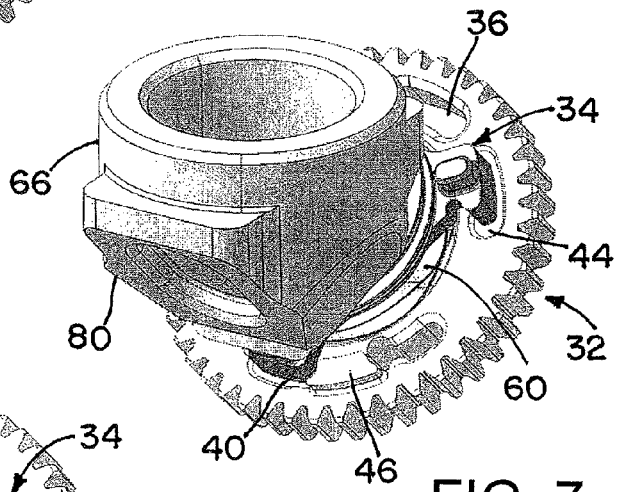
FIG. 7 is another perspective view of the exemplary rotational lock in a locked position.

Turning now to FIGS. 6-9, an unlock sequence of the rotational lock is described in detail. As shown in FIG. 6, the rotational lock 30 is in the locked position with the plurality of tabs 40 being engaged with the plurality of detents 44. To move the rotational lock 30 from the locked position to the unlocked position, the controller causes the motor to actuate. The actuation of the motor rotates the gear train, which then rotates the output gear 32 until the mechanical zero tab 46 contacts the adjacent tab 40. As shown in FIG. 7, the output gear 32 is rotated clockwise until the mechanical zero tab 46 contacts the adjacent tab 40.

Figure 8:
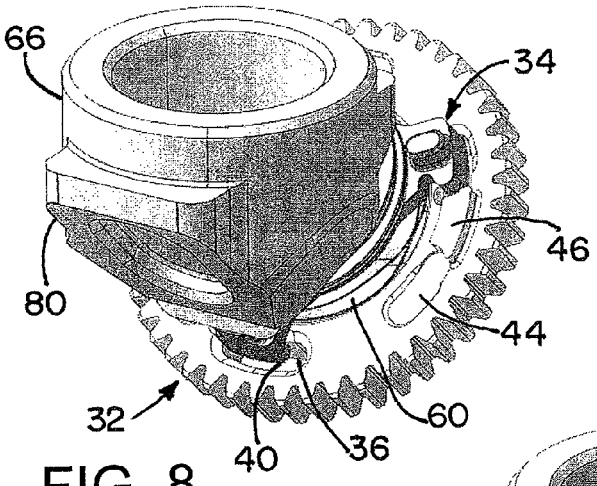
FIG. 8 is a perspective view of the exemplary rotational lock immediately prior to being in an unlocked position.
Figure 9:
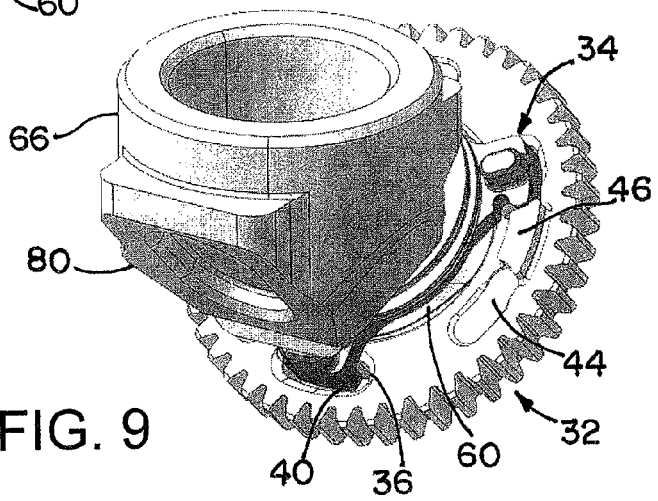
FIG. 9 is a perspective view of the exemplary rotational lock in the unlocked position.

Upon contact of the mechanical zero tab 46 and the tab 40, the controller causes the output gear 32 to rotate in the opposite direct, while keeping track of the motor position, until the tabs 40 are aligned with the bores 36 as shown in FIG. 8. Once aligned, the spring 68 is unloaded thereby axially moving the lock plate 34 until the tabs 40 are engaged with the bores 36. The axial movement of the lock plate 34 disengages the lock tabs 94 from the protrusions 90, as shown in FIG. 5, thereby placing the rotational lock 30 in the unlocked position as shown in FIG. 9. Once in the unlocked position, the lock plate 34 is coupled to the output gear 32 for common rotation to allow rotation of the shaft 20, which allows the fin 14 to be moved to a desired position.

To relock the rotational lock 30, the lock cover 74 is removed, thereby removing the preload from the spring loader 66. When the preload is removed, the spring 60 is unloaded. The unloaded spring 60 axially moves the lock plate 34 away from the lock gear 32 to disengage the tabs 40 from the bores 36 and to reengage the lock tabs 94 with the protrusions 90. The output gear 32 is then rotated until the detents 44 are aligned with the tabs 40. The lock cover 74 is then reinstalled to reapply the preload to the spring loader 66 to cause the spring 68 to axially move the lock plate 34 until the tabs 40 engage the detents 44.

Referring now to FIGS. 10-14, another exemplary embodiment of a rotational lock is shown as 130. The rotational lock 130 is substantially the same as the above-referenced rotational lock 30, and consequently the same reference numerals, but indexed by 100 are used to denote structures corresponding to similar structures in the rotational lock 130. In addition, the foregoing description of the rotational lock 30 is equally applicable to the rotational lock 130 except as noted below. Moreover, it will be appreciated that aspects of the rotational locks 30 and 130 may be substituted for one another or used in conjunction with one another where applicable.

Figure 10:
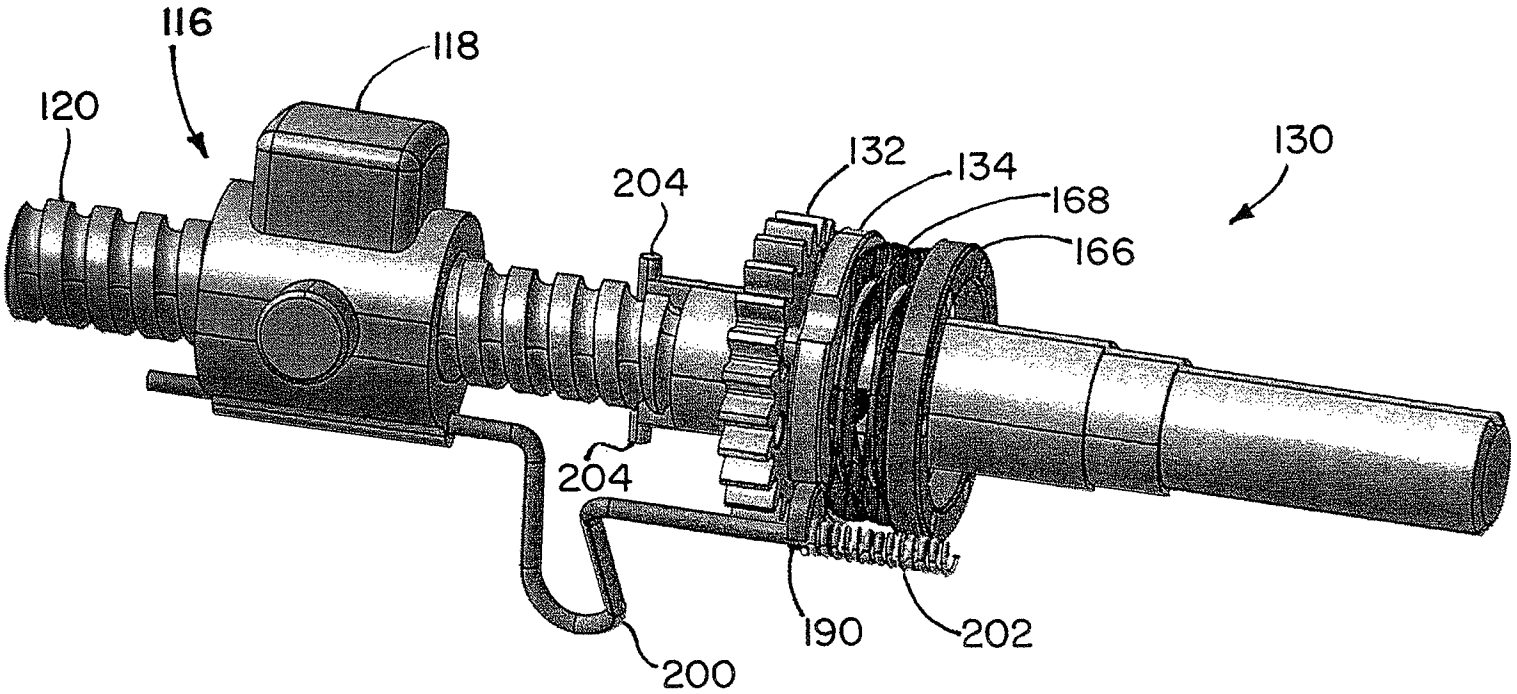
FIG. 10 is a perspective view of yet another exemplary rotational lock according to the invention.
Figure 11:
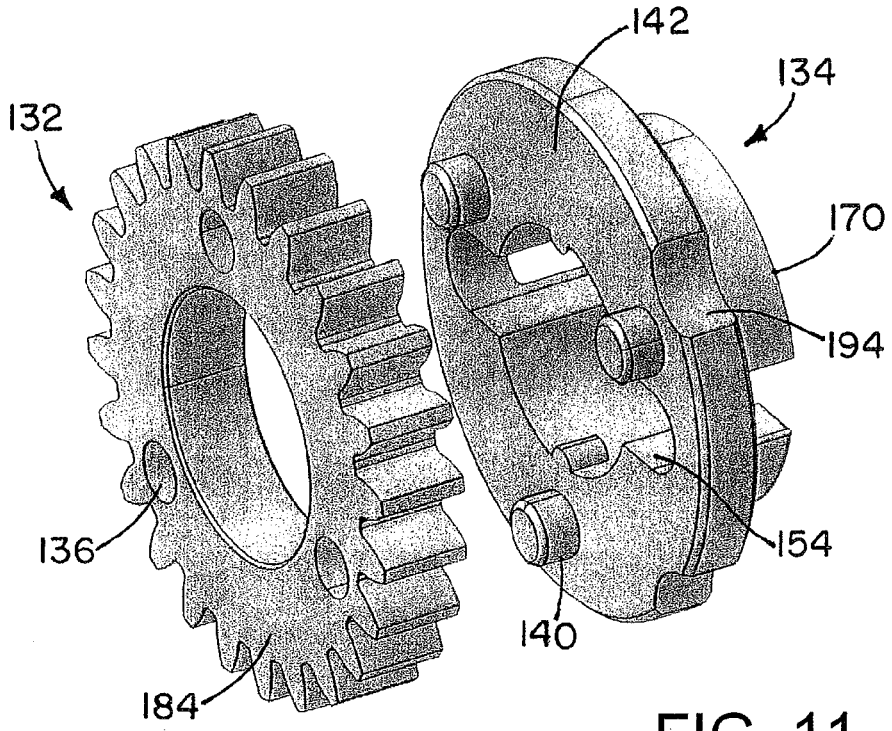
FIG. 11 is a perspective view of another output gear and lock plate according to the invention.
Figure 12:
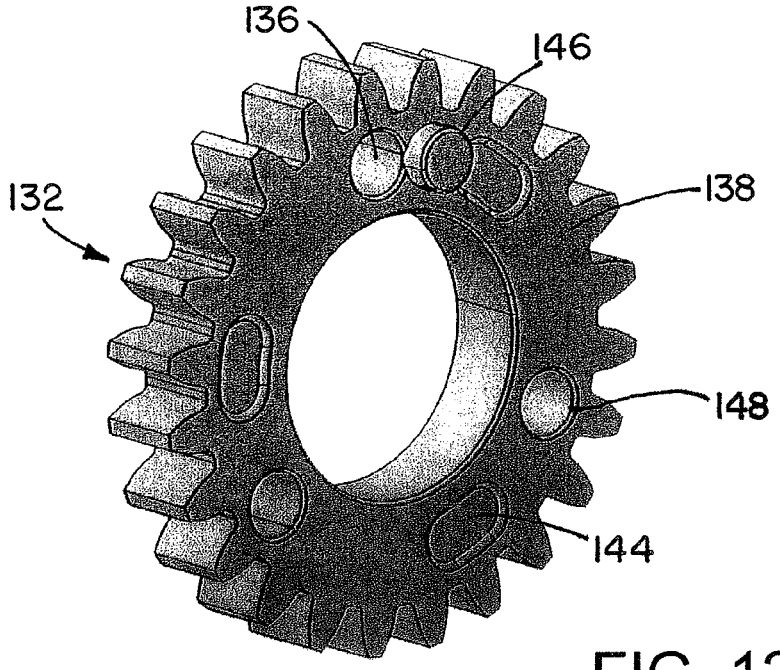
FIG. 12 is another perspective view of the output gear of FIG. 11.
Figure 13:
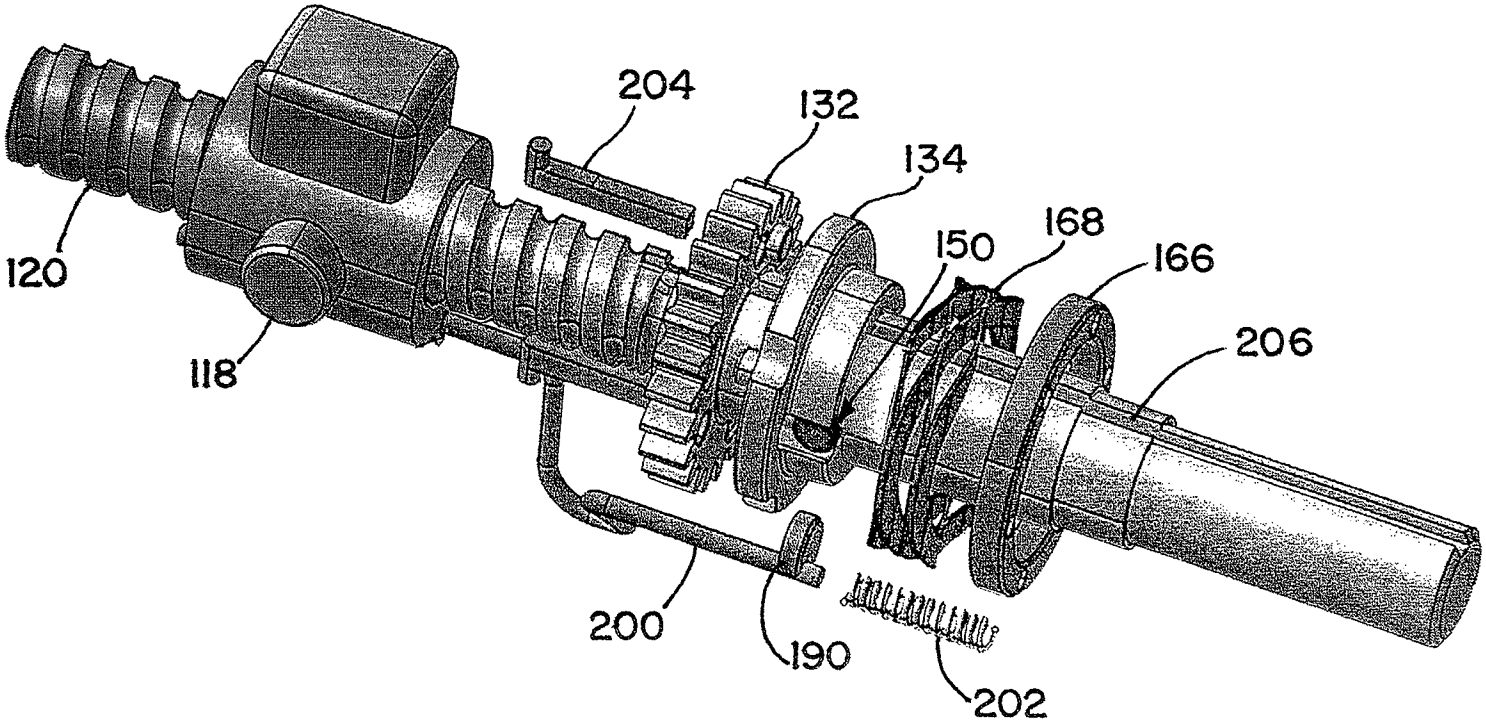
FIG. 13 an exploded perspective view of the exemplary rotational lock of FIG. 10.
Figure 14:
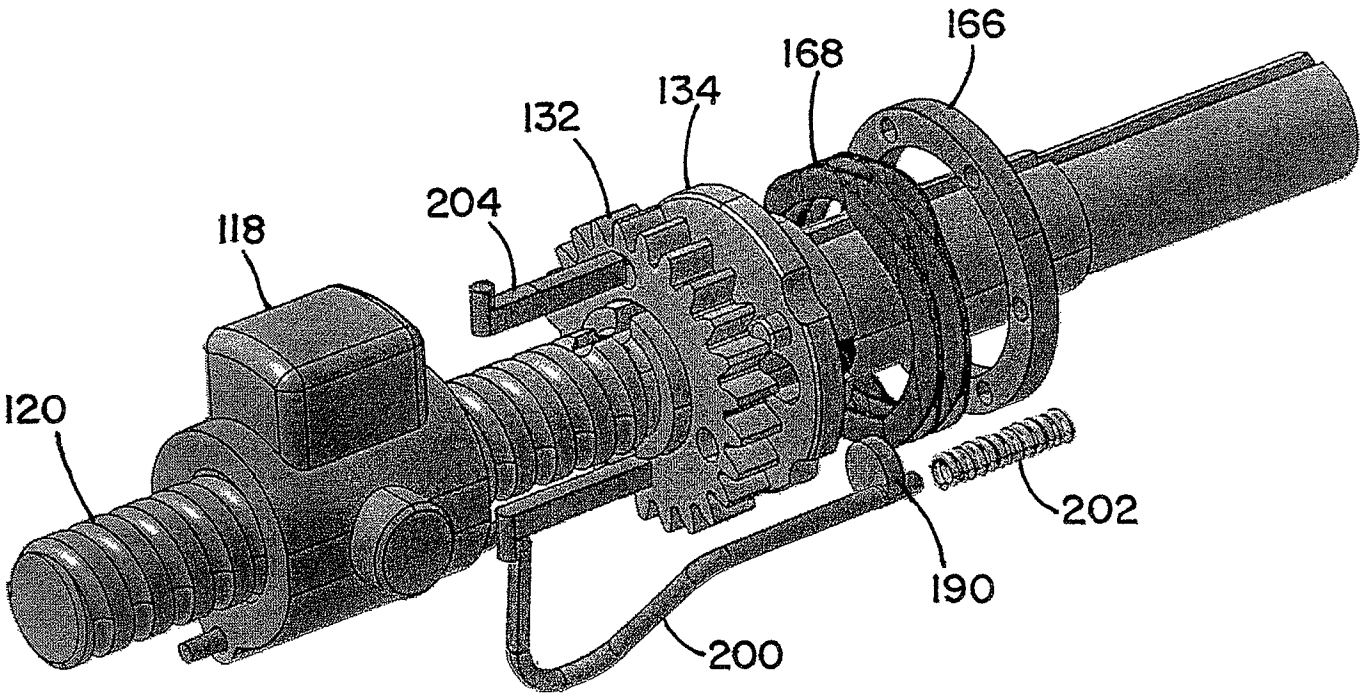
FIG. 14 another exploded perspective view of the exemplary rotational lock of FIG. 10.

In the illustrated embodiment, the fins are coupled to respective crank arms that are driven by actuator assemblies, such as ball screw and nut assembly 116 having a ball nut 118 and an output shaft 120, shown in FIG. 10, which may be of a conventional design. Each motor is connected through a gear train to a respective output shaft 120 under certain conditions, such that actuation of the motor causes the output shaft 120 to rotate, thereby causing the ball nut 118 to translate to move the fin to a desired position. Although described as including a plurality of motors mechanically coupled to respective rotational locks, it will be appreciated that one motor may be mechanically coupled to more than one rotational lock.

Turning now to FIGS. 10-14, the exemplary rotational lock 130 for locking the fins in the null position is shown. The rotational lock includes an output gear 132 and a lock plate 134 that are mounted on the output shaft 120. When assembled, the output gear 132 and the lock plate 134 are mounted on the shaft 120 with a first face 138 of the output gear adjacent a first face 142 of the lock plate. Disposed between a second face 164 of the lock plate 134 and a bearing retainer 166 is a spring 168. The spring 168 is seated by a protrusion 170 on the second face 164 of the lock plate 134. The spring 168 may be any suitable spring provided to bias the lock plate 134 in the locked position. The bearing retainer 166 is mounted around the shaft 120 and held in place by any suitable means, for example by a wall of a housing surrounding the rotational lock 130. The bearing retainer 166 is provided to prevent the spring 168 from moving axially along the shaft 120 away from the lock plate 134. It will be appreciated however that the bearing retainer 66 may be replaced by any suitable element for maintaining the position of the spring 168.

The rotational lock 130 also includes a retention mechanism 190 coupled to a distal end of a delay spring 200. The retention mechanism 190, which may be a lock tab and will hereinafter be referred to as such, is engageable in the locked position with one of a plurality of detents 194 circumferentially spaced along an outer wall of the lock plate 134. The lock tab 190 and the detent 194 are engageable to prevent the fin 14 from being moved from the null position when the output gear 132 rotates and/or when the fin is subjected to high aerodynamic loading. The delay spring 200, which has a proximal end extending through a bore in a ball nut 118 and which is axially movable relative to and with the ball nut, is held in place by a housing (not shown) surrounding the rotational lock 130 when the rotational lock 130 is in the locked position.

To unlock the rotational lock 130 from the locked position shown in FIG. 10, where the plurality of tabs 140 are engaged with the plurality of detents 144, the controller causes the motor to actuate. The actuation of the motor rotates the gear train, which then rotates the output gear 132 until the mechanical zero tab 146 contacts the adjacent tab 140. Upon contact of the mechanical zero tab 146 and the tab 140, the controller causes the output gear 132 to rotate in the opposite direct, while keeping track of the motor position, until the tabs 140 are aligned with the bores 136. Once aligned, the spring 168 is unloaded thereby axially moving the lock plate 134 until the tabs 140 are engaged with the bores 136. The axial movement of the lock plate 134 disengages the lock tab 190 from the detent 194, thereby placing the rotational lock 130 in the unlocked position.

To relock the rotational lock 130, the controller causes the motor to actuate to rotate the gear train and drive the ball nut 118 toward the output gear 132. The movement of the ball nut 118 toward the output gear 132 causes the delay spring 200 to be moved axially away from the lock plate 134 and toward the bearing retainer 166, thereby loading the delay spring 200 and a return spring 202. The return spring is mounted on the distal end of the delay spring 200 and has one end abutting a side of the lock tab 190 facing the bearing retainer 166 and another end abutting the housing.

As the ball nut 118 moves toward the output gear 132, the ball nut contacts at least one lock slide 204, and in the illustrated embodiment two lock slides, that are disposed in grooves 206 in the shaft 120. The ball nut 118 moves the lock slides 204 toward the output gear 132 and into contact with the face 142 of the lock plate 134. The ball nut 118 then continues to move the lock slides 204 to push the lock plate 134 axially away from the gear 132.

To avoid inadvertently disengaging the gear train, full travel of the lock slides 204 does not fully disengage the tabs 140 from the bores 136. Upon full travel of the lock slides 204, the tabs 140 will be seated in ramps 148 in the bores 136. The motor will continue to actuate to rotate the output gear 132, which causes the tabs 140 to be pushed out of the ramps 148 and therefore out of engagement with the bores 136. By using the lock slides to move the lock plate 134 axially away from the output gear 132, the rotational lock 130 does not require a spring disposed between the output gear the lock plate, although it will be appreciated that such a spring may be provided if desired.

After the tabs 140 have been disengaged from the bores 136, the output gear 132 is rotated until the mechanical zero tab 146 contacts one of the tabs 140. The output gear 132 is then rotated in the opposite direction, which causes the tabs 140 to engage the detents 144. The output gear continues to rotate to move the ball nut 118 away from the output gear 132 toward the null position. As the ball nut 118 moves toward the null position, the delay spring 200 begins unloading. When the ball nut 118 is near the null position, the delay spring has been completely unloaded, causing the return spring 202 to be unloaded to push the lock tab 190 into contact with the second face 164 of the lock plate 134. As the ball nut is moved to the null position, the lock plate 134, which is still rotating with the output gear 132, rotates until the detent 194 is aligned with the lock tab 190. The lock tab 190 then is moved into the detent 194 by the return spring 202, locking the rotational lock 130 and preventing the fin from moving from the null position.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A rotational lock assembly for a control surface, including:

an output shaft;

an output gear rotatable about the output shaft and a lock plate keyed to the output shaft, the lock plate being axially movable along the output shaft between a first axial position and a second axial position; and a retention mechanism configured to engage the lock plate when the lock plate is in the first axial position of the lock plate to prevent rotation of the lock plate and configured to disengage from the lock plate when the lock plate is in the second axial position to allow rotation of the lock plate;

wherein the output gear includes one or more locking members axially alignable with corresponding locking members on the lock plate by rotation of the output gear relative to the lock plate from a first relative rotational position to a second relative rotational position, the one or more locking members and the corresponding locking members when not aligned being configured to hold the lock plate in the first axial position, and the one or more locking members and the corresponding locking members when aligned permitting axial movement of the lock plate toward the output gear to the second axial position and engagement of the one or more locking members of the output gear and the corresponding locking members of the lock plate to couple the lock plate and output gear for common rotation, whereby rotation of the output gear will effect a corresponding rotation of the output shaft.

2. The rotational lock assembly of claim 1, wherein the lock plate locking members include a plurality of tabs on a first face of the lock plate adjacent the output gear and the one or more locking members of the output gear include a plurality of bores extending at least partially through the output gear for receiving the plurality of tabs respectively when the locking members are aligned.

3. The rotational lock assembly of claim 2, wherein the output gear includes a plurality of detents on a face of the output gear adjacent the lock plate, the plurality of detents being engageable with the plurality of tabs in the first relative rotational position.

4. The rotational lock assembly of claim 3, wherein the output gear includes a mechanical zero tab projecting outwardly from the face of the output gear toward the lock plate, the mechanical zero tab being configured to interfere with one of the tabs during rotation of the output gear relative to the lock plate to set the output gear in a null position.

5. The rotational lock assembly of claim 2, wherein the lock plate includes a plurality of lock tabs on a second face of the lock plate opposite the first face, the lock tabs being engageable by the retention mechanism in the first axial position.

6. The rotational lock assembly of claim 5, further comprising a housing at least partially enclosing the lock plate and output gear, and wherein the retention mechanism includes a plurality of protrusions extending inward from the housing.

7. The rotational lock assembly of claim 5, further including a housing and spring loader removably mounted to the housing, the spring loader when mounted to the housing applying a preload to a first spring that biases the lock plate, when in the first axial position, toward the second axial position of the lock plate.

8. The rotational lock assembly of claim 7, further including a second spring between the output gear and the lock plate, wherein the second spring applies a biasing force that moves the lock plate from the second axial position to the first axial position when the spring loader is removed.

9. The rotational lock assembly of claim 1, wherein the lock plate includes a plurality of lock detents circumferentially spaced along an outer wall of the lock plate, wherein one of the lock detents is engageable with the retention mechanism in the first axial position.

10. The rotational lock assembly of claim 9, wherein the retention mechanism includes a lock tab disposed on a distal end of a delay spring.

11. The rotational lock assembly of claim 10, wherein the delay spring has a proximal end disposed in a bore of a ball nut, the proximal end of the delay spring being axially movable relative to and with the ball nut.

12. The rotational lock assembly of claim 10, further including a plurality of lock slides configured to axially move the lock plate away from to output gear when the rotational lock is in the second position.

13. The rotational lock assembly of claim 1, wherein the first axial position corresponds to a locked position of the rotational lock assembly and the second axial position corresponds to an unlocked position of the rotational lock assembly.

14. The rotational lock assembly of claim 1, wherein the output gear is rotatable relative to the lock plate within a prescribed angle when the lock plate is in the first axial position, the prescribed angle being controlled by a mechanical zero tab on a face of the output gear.

15. A rotational lock system for a control surface including:

a motor;

an output shaft configured to be coupled to a control surface;

an output gear coupled to the motor by a gear train, the output gear being rotatable about the output shaft;

a lock plate keyed to the output shaft and axially movable along the output shaft; and a retention mechanism configured to engage the lock plate in a first axial position to prevent rotation of the lock plate;

wherein in a first movement state of the motor, actuation of the motor causes the output gear to move from a first rotational position to a second rotational position so that one or more locking members on the output gear align with corresponding locking members on the lock plate, the lock plate, when in the second rotational position, being axially movable under a biasing force toward the output gear to a second axial position to disengage the lock plate from the retention mechanism and to couple the lock plate and output gear for common rotation; and wherein in a second movement state of the motor, actuation of the motor causes the output shaft to rotate whereby the control surface can be moved to a desired position.

16. The rotational lock system of claim 15, further including a controller for controlling the motor.

17. The rotational lock system of claim 16, wherein the output gear includes a mechanical zero tab projecting outwardly from the face of the output gear toward the lock plate, the mechanical zero tab being configured to interfere with one of the locking members on the lock plate in the first movement state.

* * * * *